United States Patent [19]

Sone et al.

[11] Patent Number: 4,728,853

[45] Date of Patent: Mar. 1, 1988

[54] COLOR PICTURE TUBE WITH SUPPORT ARRANGEMENT FOR A RECTANGULAR SHADOW MASK

[75] Inventors: Toshinao Sone, Kumagaya; Kazunori Nakane, Konosu; Ryuichi Murai; Hiroshi Urata, both of Fukaya, all of Japan

[73] Assignee: Kabushiki Kaisha Toshiba, Kawasaki, Japan

[21] Appl. No.: 878,680

[22] Filed: Jun. 26, 1986

[30] Foreign Application Priority Data

Jun. 27, 1985 [JP] Japan ..... 60-138950

[51] Int. Cl.[4] ..... H01J 29/07

[52] U.S. Cl. ..... 313/406; 313/407

[58] Field of Search ..... 313/406, 407, 404

[56] References Cited

U.S. PATENT DOCUMENTS 3,529,199 9/1970 Duistermaat et al. ..... 313/404
3,832,592 8/1974 Yamazaki et al. ..... 313/404
4,300,071 11/1981 Dougherty et al. ..... 313/407

FOREIGN PATENT DOCUMENTS 46-4104 2/1971 Japan .
58-144 1/1983 Japan .
60-12736 4/1985 Japan .

*Primary Examiner*—Palmer C. DeMeo
*Attorney, Agent, or Firm*—Oblon, Fisher, Spivak, McClelland & Maier

[57] ABSTRACT

In a color picture tube in which a shadow mask is placed close to a phosphor screen inside an envelope which has an oblong-shaped panel, the shadow mask is supported at the four corners of the panel by plate spring members. The spring members are each constructed from a 1st member which is fixed so that it is easily mounted on and dismounted from the stud pins on the panel and a 2nd member which is welded to the mask frame of the shadow mask. These members are incorporated as one by face-welding together at their ends. In this type of spring member structure, the members work together to alleviate the bending deformation which is applied to the members through the repeated mounting of the shadow mask panel which accompanies production.

4 Claims, 14 Drawing Figures

COLOR PICTURE TUBE WITH SUPPORT ARRANGEMENT FOR A RECTANGULAR SHADOW MASK

BACKGROUND OF THE INVENTION

This invention relates to a shadow mask type color picture tube and, more particularly to the shadow mask supporting structure.

For supporting a shadow mask in a color picture tube, the method of suspension by panel stud pins embedded at the diagonals of the panel inner wall and using spring members is already known.

For example, Japanese Patent Publication No. 46-4104 describes the construction of a shadow mask which is secured at the four corners of the roughly oblong-shaped or rectangular panel window by spring members. When the spring members described in the Publication are used, as shown in FIG. 3, the shadow mask 8 moves slightly towards a phosphor screen 5 through expansion due to rise in temperature. A shift of electron beam 4 also occurs caused by the relative displacement between the shadow mask aperture and the relevant phosphor dots on the screen due to this expansion, so color reproduction error being corrected.

When a spring member is designed based on the above correction principle, it is shown in FIG. 4 which is described in U.S. Pat. No. 4,300,071 (Dougherty). It is a spring member 10 which is constructed by bending a metal strip which is secured at one end to a frame 9, which supports a shadow mask 8, or to a rigid support secured to that frame and at the other end is secured to a panel stud pin 2. However, this construction has a fault in that, when the mounting and dismounting of spring member 10 is repeated several times and it is bent as shown by broken line 10*a* during the process of making a color picture tube, plastic deformation occurs at bend 10, and it does not recover its original shape.

In addition, since four spring members are used to support one shadow mask and, they are mass-produced, it is impossible to make a completely homogeneous set. Mounting on the stud pins more than once and the heating to which they are subjected during the color picture tube manufacturing process causes the differences of randomness in the properties of these spring members to increase, so some members occuring unexpectedly plastic deformation. When the deformation of one of the four spring members secured to the shadow mask is greater than that of the others, the shadow mask is displaced from the desired position. As a result, the paths of the electron beams which pass through the shadow mask are shifted from the phosphor dots and the white uniformity deteriorates. Even if the best stainless steel (SUS631) is used for the spring members of a color picture tube, this defect can not be overcome.

As a modification to this, a spring member 20 which is bent in a dog-leg shape from the upper end of the plate portion which is welded to the frame 9 towards the stud pin 2 below, as shown in FIG. 5 can be considered. In this form, when it is bent as at a broken line position 20*a* for mounting or dismounting, since the wole of the upper portion bends from welding points 13, irrecoverable permanent deformation can be avoided. However, it has been proved that spring members which are formed by this kind of process of bending a continuous spring member have the fault of weakness to external mechanical shock. As shown in FIG. 6, when a force $F_1$ from the panel stud pin (not shown) acts on the circumference of the hole 21 which accommodates the panel stud pin, and a force $F_2$ acts in the opposite direction to force $F_1$ on the surface $20_3$ which is welded to the frame (not illustrated), permanent deformation of the spring member 23 can easily occur. This type of couple can sometimes occur when transporting color picture tubes.

When the permanent deformation was studied, it was found that the deformation of both ends $20_1$ and $20_2$ of the bend of spring member 20 due to the couple was marked. When a couple in the direction shown in FIG. 6 was applied to spring member 20, the deformation shown by the broken line $20_4$ in FIG. 7 occurred. The reason for this was proved to be that the arc portion shown by arrow $20_5$ in FIG. 8 is liable to bend, i.e., when seen in FIG. 7, the radius of the arc at the end $20_1$ becomes smaller and the radius at end $20_2$ becomes greater.

SUMMARY OF THE INVENTION

An object of this invention is to provide a color picture tube with a good beam landing characteristic, reducing the permanent deformation of the spring members due to mounting and dismounting and due to mechanical shock.

This invention is a color picture tube having an envelope in which, essentially, an oblong-shaped or rectangular panel, a cone-shaped funnel and a neck are connected with each other, a phosphor screen formed inside the panel, an electron gun housed inside the neck which emits electron beams to make the screen luminescence by excitation, an oblong-shaped or rectangular shadow mask which is essentially formed by an arrangement of a large number of apertures placed near to and facing the screen and between the screen and the electron gun, and an oblong-shaped or rectangular mask frame which supports the shadow mask around its periphery. The mask frame is secured by mens of spring members to stud pins embedded inside the walls of the panel. These spring members are constructed by a 1st spring member and a plate-shaped 2nd spring member, the 1st spring member composed of a secured end, an inclined portion which is bent from the secured end to form an obtuse angle with the plane of the secured end as the reference position of bending, and a supporting portion which is extended by bending from the inclined portion and has a hole in it in which the stud pin is accommodated. The plate-shaped 2nd spring member is interposed between the mask frame and the 1st spring member. The 2nd spring member is composed of a secured portion which is welded to the mask frame along the surface of the mask frame, an elastic portion which is made to be able to deform elastically with the rederence position being the weld position, and a joint portion to which the secured end of the 1st spring member is joined on its surface so that the bend position of the secured end of the 1st spring member is at a fixed distance from the weld position.

PREFERRED EMBODIMENT OF THE INVENTION

Figure 1:
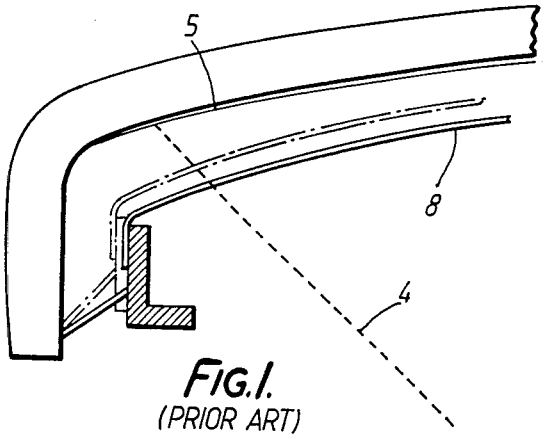
FIG. 1. (PRIOR ART)
FIG. 1 is a partial cross-sectional view of an embodiment of this invention.
Figure 2:
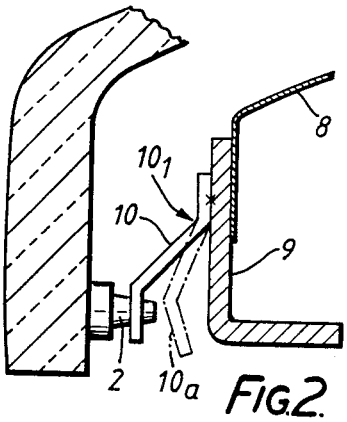
FIG. 2. (PRIOR ART)
FIG. 2 is a perspective view showing an enlarged part of FIG. 1.
Figure 3:
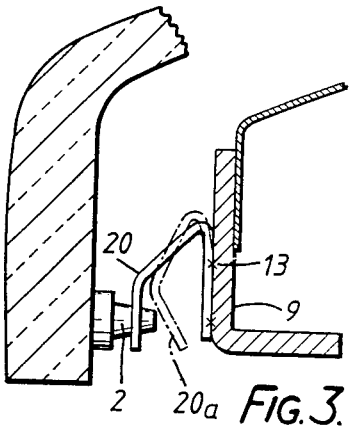
FIG. 3 is a schematic cross-sectional view of a conventional structure to illustrate the correction for heat expansion.
Figure 9:
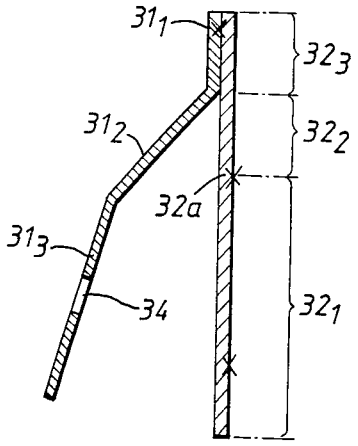
FIG. 9 is a cross-sectional view of FIG. 2 along the line II—II.

Embodiments of this invention are described below with reference to drawings. FIGS. 1, 2 and 9 show an embodiment of this invention. The color picture tube has an envelope 14 constructed from a panel 11 made of glass which is essentially oblong-shaped or rectangular when seen from the viewers, a funnel 12 which is sealed around panel 11, and a neck 23 which is connected to the tapered section of funnel 12. On the inner surface of panel 11 a phosphor screen 15 is formed in a striped pattern of colored phosphor which emits the 3 colors of red, green and blue. Facing screen 15, an electron gun 16 which emits three electron beams exciting phosphor is housed inside neck 23.

Between screen 15 and electron gun 16 a shadow mask 18 is provided close to the screen. Shadow mask 18 is made of 0.2 mm thick iron sheet having a large number of slit-shaped apertures 17 etched in it by which the three electron beams are selectively divided onto the screen. The periphery of shadow mask 18 is secured to a relatively thin iron mask frame 19 of 0.4 mm thickness which is thicker than the plate thickness of the shadow mask. Screen 15 and shadow mask 18 are both roughly oblong-shaped or rectangular and, as shown in FIG. 1, spring members 30 are welded to the outsides of the four corners of mask frame 19 which correspond to each diagonal axis of the oblongs.

Spring member 30, as shown in FIGS. 2 and 9, is made up of 2 pieces of 0.4 mm stainless steel (SUS631) (precipitation-hardened stainless steel as specified by Japan Industrial Standard JIS:4305). The 1st spring member 31 forms a supporting section. Member 31 is formed with a fixed end $31_1$ parallel to the outer wall surface of mask frame 19, an inclined portion $31_2$ which forms an obtuse angle $\theta$ with the fixed end and which is bent from there with bending position 31*a* as a basis and a supporting portion $31_3$, having a supporting hole 34 to accommodate stud pin 22 and which is extended from the inclined portion. The reasons for making $\theta$ an obtuse angle are so that the bend of the spring member agrees with the displacement due to the expansion of the shadow mask and also so that the strength of the spring member can be maintained at a relatively high level.

The 2nd plate-shaped spring member 32 is positioned between 1st spring member 31 and frame 19. 2nd spring member 32 is welded at several points along frame 19 on one of the outer walls of the four corners with a fixed portion $32_1$. An elastic portion $32_2$ extends from fixed portion $32_1$. The welding point 32*a* which divides the elastic portion and fixed portion $32_1$ is positioned at the point which becomes the reference position when the elastic portion deforms elastically. This elastic portion $32_2$ has a specified length and, moreover, a joint portion $32_3$ which extends from it. Fixed end $31_1$ of 1st spring member 31 is fixed by welding with a surface joint to joint portion $32_3$. An example of the measurements of the spring members in a 20-inch color picture tube is as follows.

1st Spring Member 31

Plate thickness: 0.35 mm; width of fixed end $31_1$ 13 mm, length 3.5 mm; Width of inclined portion $31_2$ 13 mm, length 12.5 mm, angle $\theta$ formed by the fixed end and the inclined portion from 128 to 117 degrees; Width of supporting portion $31_3$ 15 mm, length 15 mm, center of hole 34 is 5 mm from the boundary with the inclined portion.

2nd Spring Member 32

Plate thickness: 0.35 mm, Width 13 mm; Length of fixed portion $32_1$ 11 mm; Length of elastic portion $32_2$ 3.1 mm; Length of joint portion $32_3$ 3.1 mm.

In FIG. 9, points X show welding positions and at each place there are 2 spots across the width of the plate. In particular, welding points 32*a* become the reference point when elastic portion $32_2$ exhibits elastic deformation.

Figure 7:
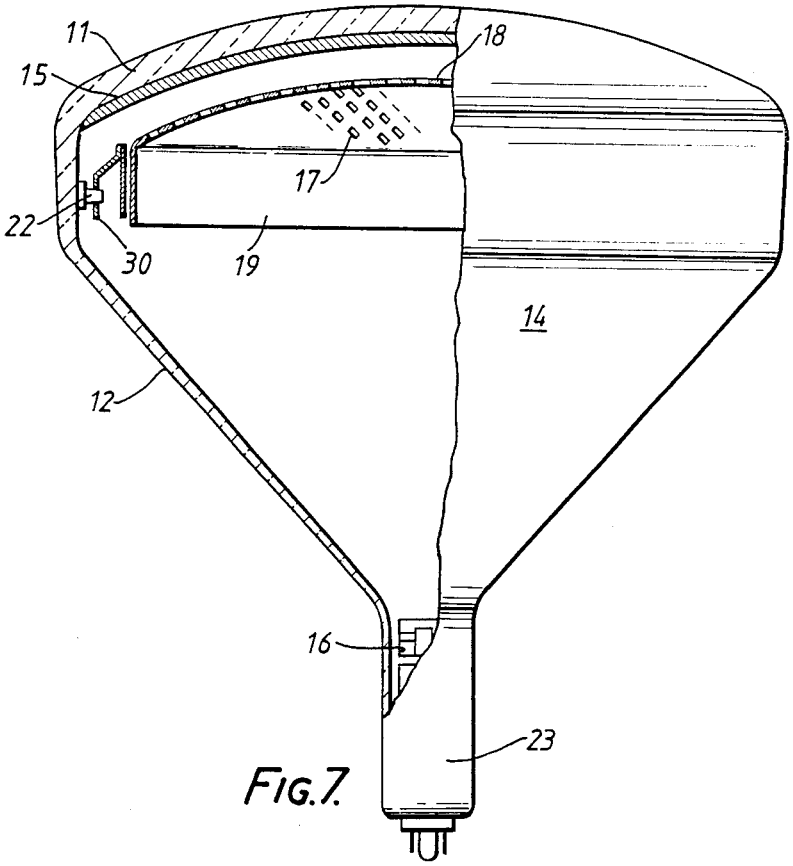
FIG. 7 is a front elevation to explain the deformation of the structure in FIG. 6.
Figure 8:
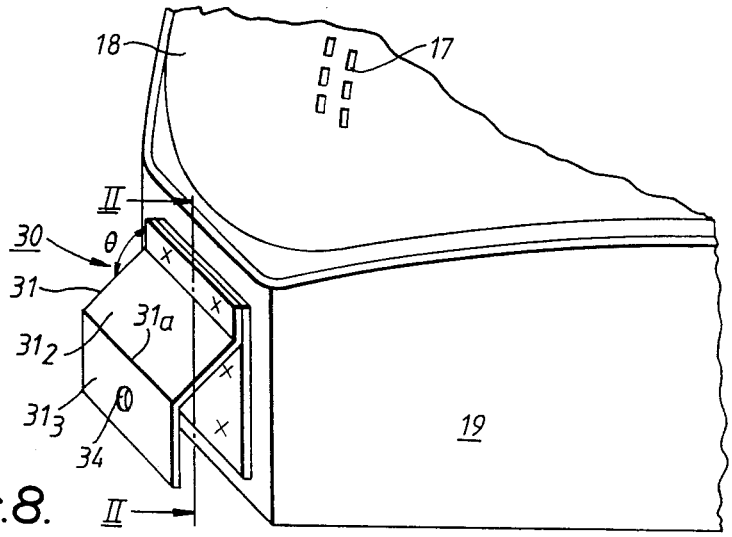
FIG. 8 is an enlarged view of the bent portion of the structure in FIG. 6.
Figure 10:
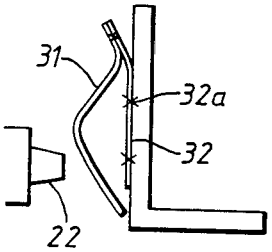
FIG. 10 is a partial cross-sectional view showing the state when the shadow mask of an embodiment of this invention is mounted on or dismounted from the panel stud pins.
Figure 11:
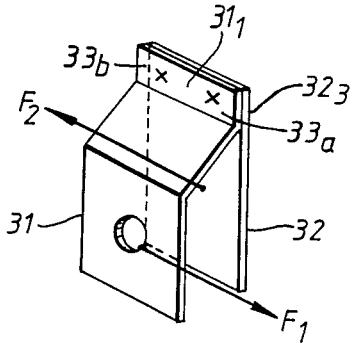
FIG. 11 is a perspective view to illustrate an embodiment of this invention.

When such spring members of this invention are bent for mounting and dismounting as shown in FIG. 10, since elastic portion $32_2$ of 2nd spring member 32 also bends outwards, it disperses part of the shock and so the stress does not concentrate in a specific part of the 1st member and permanent deformation will not occur. Moreover, when forces, for instances $F_1$ and $F_2$, act in the width direction of a spring member due to external shock, as shown in FIG. 11, a compression force will occur in one end 33*a* of the welded joint portion of 1st and 2nd spring members 31 and 32, while a tensile force will occur at the other end 33*b*. However, generally the deformation due to compression and tensile forces in materials from the viewpoint of material kinetics is far smaller than the bending deformation which occurs in the bending portions of the arcs shown in FIGS. 6 to 8. Therefore, the permanent deformation which occurs due to shock is also smaller.

Figure 6:
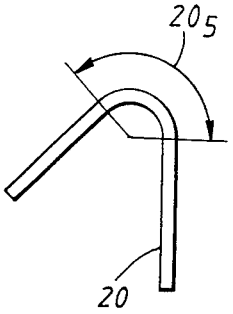
FIG. 6 is a perspective view of the spring supporting structure in FIG. 5.

In fact, color picture tubes were made experimentally using spring members of conventional structures, for example as in FIG. 6, and of the structure of this invention, as shown in FIG. 11. Tests were carried out by applying shock by dropping under the same conditions in each case. The fluctuation of beam landing was 102 $\mu$m for the conventional product and 56 $\mu$m for this invention.

Figure 4:
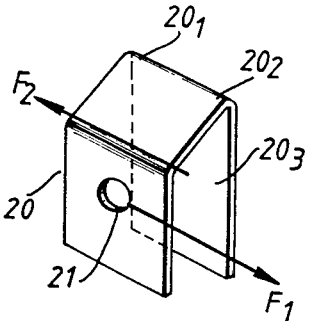
FIG. 4 is a schematic cross-sectional view of a conventional spring supporting structure.
Figure 5:
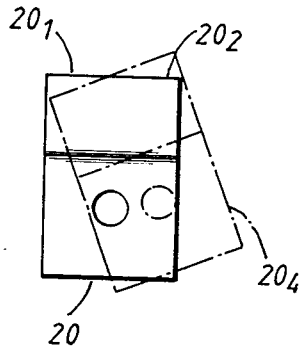
FIG. 5 is a schematic cross-sectional view of an improved spring supporting structure.
Figure 12:
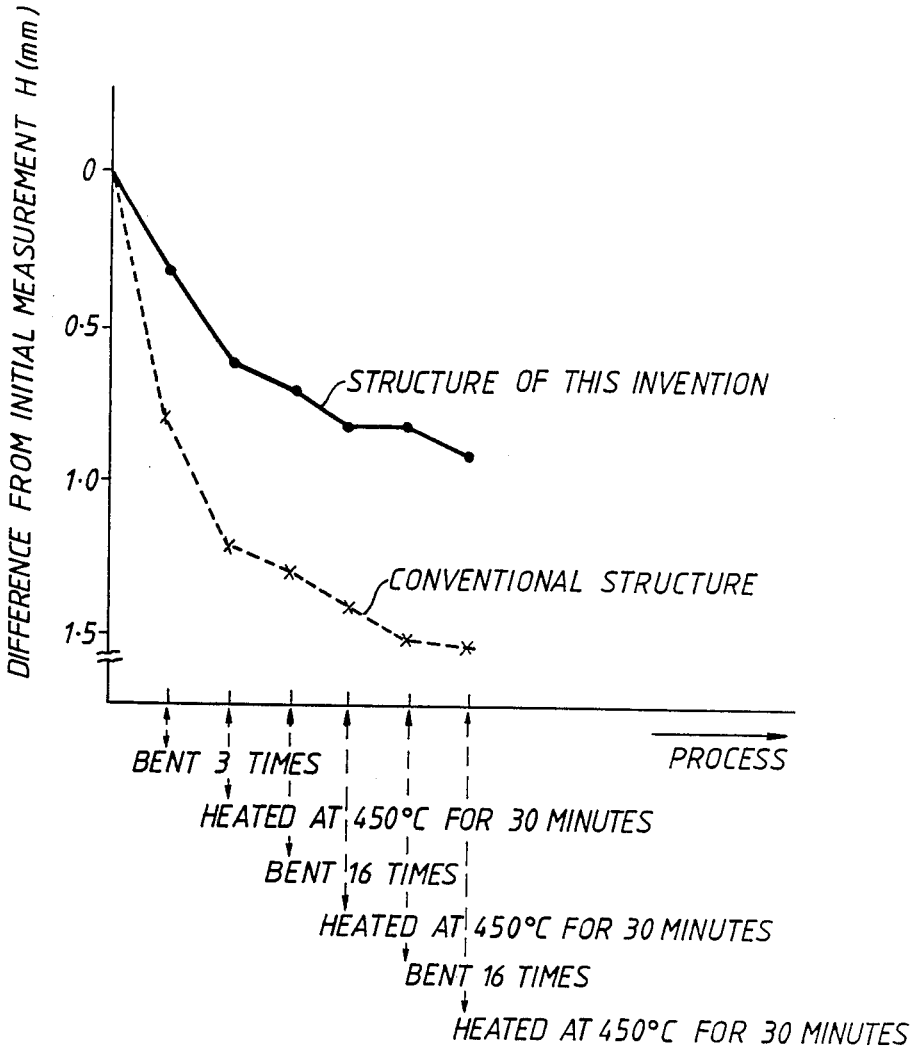
FIG. 12 is a graph of characteristic curves showing the difference for repeated tests of the initial measurement distances H of spring members by comparing an embodiment of this invention with a conventional structure.
Figure 13:
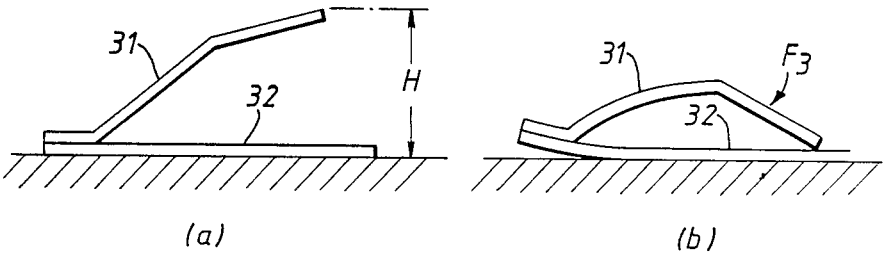
FIG. 13 is side elevations illustrating the method of the spring member bending test with reference to FIG. 12 in which (a) shows the state of a spring member before bending and (b) shows the bent state of a spring member.

Moreover, FIG. 12 shows the results of fatigue tests on spring members of 28-inch color picture tubes. This shows the results of alternate testing by repeated bending test when a stress $F_3$ is applied more than once to the original condition A in FIG. 13(*a*) in the direction of the arrow to bend the member to condition B in FIG. 13(*b*), and by a heating process (450° C., 30 minutes). In more detail, the distance H(mm) between the ends of 1st spring member 31 and 2nd spring member 32 under condition A was tested by the processes mentioned above to find how much it would decrease. The solid line shows the characteristic of an embodiment of this invention and the broken line shows the characteristic of the conventional structure shown in FIG. 4.

From the above results, it is proved that the structure of this invention is no weaker than that of conventional products. Even after the production of color picture tubes, excellent supporting characteristics are ensured and there is little risk of undesirable deterioration of white uniformity.

In another embodiment of this invention, the thickness of 1st spring member 31 was made 0.4 mm and that of 2nd spring member 32 was made 0.5 mm. Thus, the 2nd spring member was made slightly thicker. By this means, strength against shock can be improved and, furthermore, since the force required to bend the 1st spring member for mounting and dismounting does not increase greatly, the work of mounting and dismounting does not become more difficult. However, if 2nd spring member 32 is made too thick, permanent deformation will occur when mounting and dismounting in the same way as for the conventional spring member shown in FIG. 4. It was found experimentally that there was less permanent deformation when mounting and dismounting if the thickness of the 2nd spring member was within the range of 1 to 2 times the thickness of the 1st spring member. If the thicknesses are in this range permanent deformation will not occur, while sufficient mechanical strength is maintained.

Figure 14:
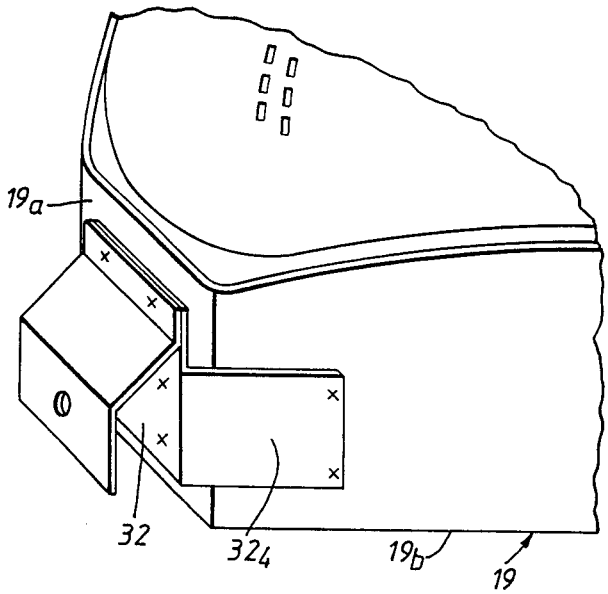
FIG. 14 is a perspective view of a spring member of another embodiment of this invention.

A further embodiment of this invention is the structure shown in FIG. 14. The 2nd spring member 32 is constructed having an arm $32_4$ which extends from a corner section 19*a* of frame 19 to an adjacent section 19*b*.

Incidentally, although the method of supporting at the corners has been described above, to carry out correction for heat expansion the method of supporting at the midsections of the frame sides on the principle shown in FIG. 2 is also possible and, needless to say, this invention can also be applied for such a method.

As described, a color picture tube can be produced by welding together the 1st and 2nd spring members at their ends and securing the 2nd spring member to the periphery of the frame or the mask. This always maintains the characteristic of good been landing and permanent deformation due to mounting and dismounting or to external shock is small.

We claim:

1. A color picture tube comprising an envelope provided with a rectangular-shaped panel, funnel and a neck; a phosphor screen formed inside said panel; an electron gun housed inside said neck which emits electron beams to make said screen luminescence by excitation; a rectangular-shaped shadow mask which has a large number of apertures placed near to and facing said screen and between said screen and said electron gun; and a rectangular-shaped mask frame which supports said shadow mask around its periphery; springs securing said mask frame to stud pins embedded inside walls of said panel; and wherein each of said springs comprises:

a 1st spring member, which is composed of a secured end, an inclined portion which is bent from the secured end to form an obtuse angle with the plane of said secured end as a reference position of bending, and a supporting portion which is extended by bending from said inclined portion and has a hole in it in which said stud pin is accommodated; and a plate-shaped 2nd spring member interposed between said mask frame and said 1st member, said plate-shaped 2nd spring member comprising a secured portion which is fixed with welding portions to said mask frame along the surface of said mask frame, an elastic portion which is extended from said secured portion and is elastically deformable, and a joint portion extended from said elastic portion, and secured end of said 1st spring member overlapping and joined to said joint portion of said second spring member with said joint portion interposed between said secured end and said mask frame, said secured end joined on a surface thereof to said joint portion of said second spring member with the joint portion interposed between the secured end and said mask frame at said surface.

2. The color picture tube according to claim 1, said springs are secured to outer walls of four corners of said mask frame.

3. The color picture tube according to claim 1 in which the thickness of said 2nd spring member are 1 to 2 times the thickness of said 1st spring members.

4. The color picture tube according to claim 1 in which said 2nd spring members are provided with arms which extend to be fixed to adjacent sections of said mask frame.

* * * * *